US005628549A

United States Patent [19]

Ritchey et al.

[11] Patent Number: 5,628,549

[45] Date of Patent: May 13, 1997

[54] CUTTING TOOL SLEEVE ROTATION LIMITATION SYSTEM

[75] Inventors: Cary D. Ritchey, Curryville; Robert H. Montgomery, Jr., Everett, both of Pa.

[73] Assignee: Kennametal Inc., Latrobe, Pa.

[21] Appl. No.: 573,220

[22] Filed: Dec. 13, 1995

[51] Int. Cl.[6] ..... E21C 35/197

[52] U.S. Cl. ..... 299/104; 299/107

[58] Field of Search ..... 299/106, 107, 299/104; 175/354

[56] References Cited

U.S. PATENT DOCUMENTS

| | | | |
|---|---|---|---|
| 3,498,677 | 3/1970 | Morrow | 299/106 X |
| 3,519,309 | 7/1970 | Engle et al. | 299/107 |
| 3,652,130 | 3/1972 | Elders | 299/106 |
| 3,697,137 | 10/1972 | Krekeler | 299/106 |
| 3,749,449 | 7/1973 | Krekeler | 299/102 |
| 3,841,708 | 10/1974 | Kniff et al. | 299/107 X |
| 4,201,421 | 5/1980 | Den Besten et al. | 299/107 |
| 4,462,638 | 7/1984 | DenBesten | 299/104 |
| 4,484,783 | 11/1984 | Emmerich | 299/107 |
| 4,603,911 | 8/1986 | Hindmarsh et al. | 299/104 |
| 4,650,254 | 3/1987 | Wechner | 299/102 |
| 4,813,501 | 3/1989 | Mills et al. | 175/335 |
| 4,893,875 | 1/1990 | Lonn et al. | 299/113 |
| 4,911,504 | 3/1990 | Stiffler et al. | 299/113 |
| 5,011,229 | 4/1991 | O'Neill et al. | 299/102 |
| 5,040,850 | 8/1991 | Komotzki | 299/106 |
| 5,067,775 | 11/1991 | D'Angelo et al. | 299/104 |
| 5,098,167 | 3/1992 | Latham | 299/104 |
| 5,106,166 | 4/1992 | O'Neill | 299/106 X |
| 5,273,343 | 12/1993 | Ojanen | 299/10 |
| 5,303,984 | 4/1994 | Ojanen | 299/106 |
| 5,503,463 | 4/1996 | Ojanen | 299/107 |

OTHER PUBLICATIONS

U.S. Patent Application Entitled "Cutting Tool Holder Retention System," Filed Aug. 2, 1995, U.S. Serial No. 08/510,451.

U.S. Patent Application Entitled "Cutting Tool Retention System," Filed Aug. 2, 1995, U.S. Serial No. 08/510,160.

*Primary Examiner*—David J. Bagnell

*Attorney, Agent, or Firm*—John J. Prizzi

[57] ABSTRACT

A tool sleeve rotation limitation system for reducing the rotation of a tool sleeve within a block bore of a support block, the tool sleeve having a sleeve engagement surface and the block bore having a block engagement surface. The tool sleeve rotation limitation system comprises a rotation limitation member located between the tool sleeve and the block bore so as to engage the tool engagement surface and the sleeve engagement surface and reduce rotation of the tool sleeve within the block bore, the rotation limitation member having a member perimeter which conforms to at least one of the sleeve engagement surface and the block engagement surface. Alternatively the tool sleeve rotation limitation system comprises a resilient rotation limitation member located between the tool sleeve and the block bore so as to frictionally engage the tool sleeve and the block bore and reduce rotation of the tool sleeve within the block bore.

45 Claims, 4 Drawing Sheets

112
120
142
A
124
122
126
116
100
136
170
132
127
140
114
134
128
130
138
164
166
158
150
160
159
118
156
152
154

100
142
136
164
A
170
124
116
171
112
132
122
140
128
114
138
160
158
162
126
120
118
156
154
152

CUTTING TOOL SLEEVE ROTATION LIMITATION SYSTEM

TECHNICAL FIELD

This invention relates to excavation cutting tools, and more particularly, to a rotation limitation system for reducing the rotation of a cutting tool sleeve within a support block.

BACKGROUND ART

Cutting tool assemblies for such applications as continuous mining, excavating, or road milling typically comprise a cutting tool, sometimes called a cutting bit, rotatably mounted within a support block. The support block in turn is mounted onto a drum or other body, typically by welding, which in turn is driven by a suitable drive mechanism. When a number of such support blocks carrying cutting tools are mounted onto a drum, and the drum is driven, the cutting tools will engage and break up the material which is sought to be mined or removed. The general operation of such a mining, excavating, or road milling machine is well known in the art.

Because the support block is exposed, it is subject to wear and abuse and must be cut or torched off the drum and replaced when unusable. In order to prolong the life of the support block, a cutting tool sleeve, sometimes referred to as a bit sleeve, tool holder, or bit holder, is sometimes employed. The cutting tool is mounted within the tool sleeve which in turn is mounted within the support block. The tool sleeve generally has an outer wear surface which helps to protect the support block from abuse and wear during use, thus minimizing the down time otherwise required for support block replacement and drum repair. The use of such tool sleeves is well known in the art.

For example, U.S. Pat. No. 5,067,775, to D'Angelo et al., hereby incorporated by reference in its entirety, discloses the use of a tool sleeve. More specifically, and as illustrated in FIGS. 1, 2 and 3 of the D'Angelo et al. patent, the tool sleeve has a larger diameter forward portion and a smaller diameter rearward portion joined by an inclined region. When inserted into the bore of a support block, the smaller diameter rearward portion of the sleeve extends out of the back of the block and has a groove in which a retainer member is mounted. The inclined region of the tool sleeve fits against an inclined region of the tool block such that the sleeve is held in the block with a slight degree of axial movement freedom. The sleeve is also relatively freely rotatable in the support block. The sleeve, of course, includes a tool bore into which a cutting tool may be rotatably or otherwise mounted. Because the larger diameter forward portion of the sleeve protrudes from the cutting block, it bears the brunt of any abusive wear to which the support block would otherwise be subjected.

Many typical tool sleeve retention systems, such as the one disclosed in the D'Angelo et al. patent, allow the tool sleeve to rotate within the support block. In typical mining or road milling applications, especially those involving abrasive materials, dust, dirt or other debris may get into the support block bore, or otherwise between the tool sleeve and support block, and cause excessive wear to both the tool sleeve and the support block.

Various methods have been proposed or used in the past to limit or prevent rotation of a tool sleeve within a support block.

An example is shown in FIG. 1 which is an isometric view of a prior art steel clip 10 having a wavy configuration with inner apexes 12 and outer apexes 14 which was made by Kennametal Inc., located in Bedford, Pa. As shown in FIG. 2, this steel clip 10 was used with a tool sleeve 16 having a clip groove 18. More specifically, the steel clip 10 was used by placing it within the clip groove 18 as shown in FIG. 2 before inserting the tool sleeve 16 within a support block bore. The clip groove 18 was located along the longitudinal length of the tool sleeve 16 such that it would be located within the support block bore when the tool sleeve 16 was fully inserted. As a result, the steel clip 10 would be compressed within the support block bore and the inner apexes 12 and outer apexes 14 would frictionally engage both the clip groove 16 of the tool sleeve 18 and the support block bore to reduce rotation of the tool sleeve 18 relative to the support block. However, such prior steel clips 10 would sometimes fail during use as the result of wear or fatigue, especially of the inner apexes 12 or outer apexes 14, making the clips 10 unable to fulfill the function of minimizing rotation of the tool sleeve 16 within the support block bore.

SUMMARY OF THE INVENTION

An object of the present invention is to provide an improved rotation limitation system for reducing the rotation of a tool sleeve within a support block bore.

In carrying out the above object, and other objects and features of this invention, an improved tool sleeve rotation limitation system is provided for reducing the rotation of a tool sleeve within a block bore of a support block, the tool sleeve having a sleeve engagement surface and the block bore having a block engagement surface. The tool sleeve rotation limitation system comprises a rotation limitation member located between the tool sleeve and the block bore so as to engage the tool engagement surface and the sleeve engagement surface and reduce rotation of the tool sleeve within the block bore, the rotation limitation member having a member perimeter which conforms to at least one of the sleeve engagement surface and the block engagement surface.

In a more specific embodiment, the rotation limitation member has a member surface which conforms to at least one of the sleeve engagement surface and the block engagement surface.

In an alternative embodiment for reducing the rotation of a cutting tool sleeve within a support block bore, the improved rotation limitation system comprises a resilient rotation limitation member located between the tool sleeve and the support block bore so as to engage the tool sleeve and the support block bore when the tool sleeve is inserted into the support block bore and reduce the rotation of the tool sleeve within the support block bore.

In a more specific embodiment, the tool sleeve has a sleeve recess within which the rotation limitation member is located between the sleeve recess and the support block bore so as to engage the sleeve recess and the support block bore and reduce rotation of the tool sleeve within the support block bore.

In a preferred embodiment, the sleeve recess is an annular sleeve recess

In a particularly preferred embodiment, the resilient rotation limitation member has a C-clip configuration. Such a C-clip may have a generally rectangular cross-section, a recess along the inner or outer perimeter, a protrusion along the inner or outer perimeter, a varying cross-section along the length of the C-clip, or any other configuration or combination of configurations found suitable.

In all embodiments, the rotation reducing member may be such that it is compressed between the tool sleeve and the support block bore when the tool sleeve is inserted into the support block bore. Furthermore, in all embodiments the rotation limitation member may frictionally engage the block bore and the tool sleeve.

The advantages resulting from the present invention are numerous. First, the invention allows cutting tool sleeves to be mounted within the block bore of a support block such that rotation of the tool sleeve within the support block will be reduced. This will cut down on abrasive wear between the tool sleeve and the support block which might otherwise occur due to abrasive materials, dust, dirt or other debris between the tool sleeve and the support block. Furthermore, if the rotation limitation member is resilient, it will not be easily susceptible to fatigue failure. Alternatively, if the rotation limitation member has a member perimeter or member surface which conforms to at least one of the sleeve engagement surface and the block engagement surface, if will likewise be less susceptible to concentrated wear or bending fatigue failure. Additionally, if the rotation limitation member is resilient, it will typically have a co-efficient of friction such that rotation of the tool sleeve within the block bore will be reduced to a higher extent than would otherwise be the case. Likewise, if the rotation limitation member has a member perimeter or member surface which conforms to at least one of the sleeve engagement surface and the block engagement surface, the rotation limitation member will have more surface area available to engage and reduce any rotation between the tool sleeve and the support block. Also, if the rotation limitation member is resilient, it may be compressed between the tool sleeve and the block bore, thereby increasing the frictional forces and reducing rotation of the tool sleeve within the block bore even further. An additional advantage is that the tool sleeve may be converted to a normally rotatable configuration relative to the support block by not using the rotation limitation member.

Further objects and advantages of this invention will be apparent from the following description, reference being had to the accompanying drawings wherein various embodiments of the present invention are shown.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

BEST MODE FOR CARRYING OUT THE INVENTION

Figure 1:
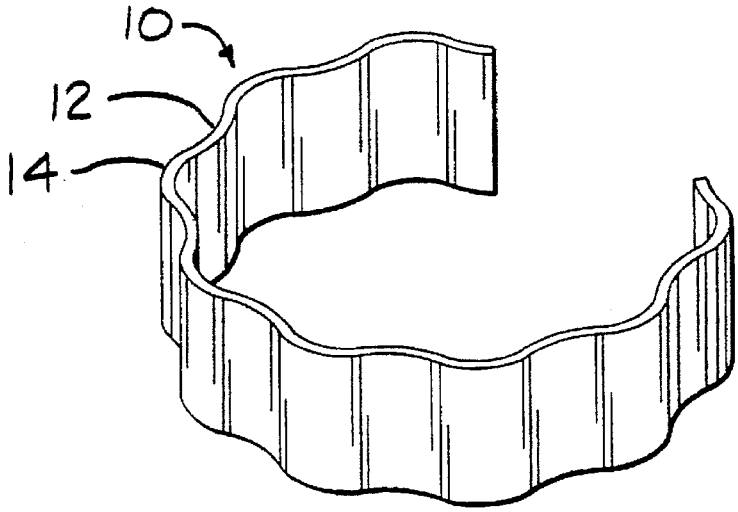
Fig. 1 (PRIOR ART)
FIG. 1 is an isometric view of a prior art steel clip.
Figure 2:
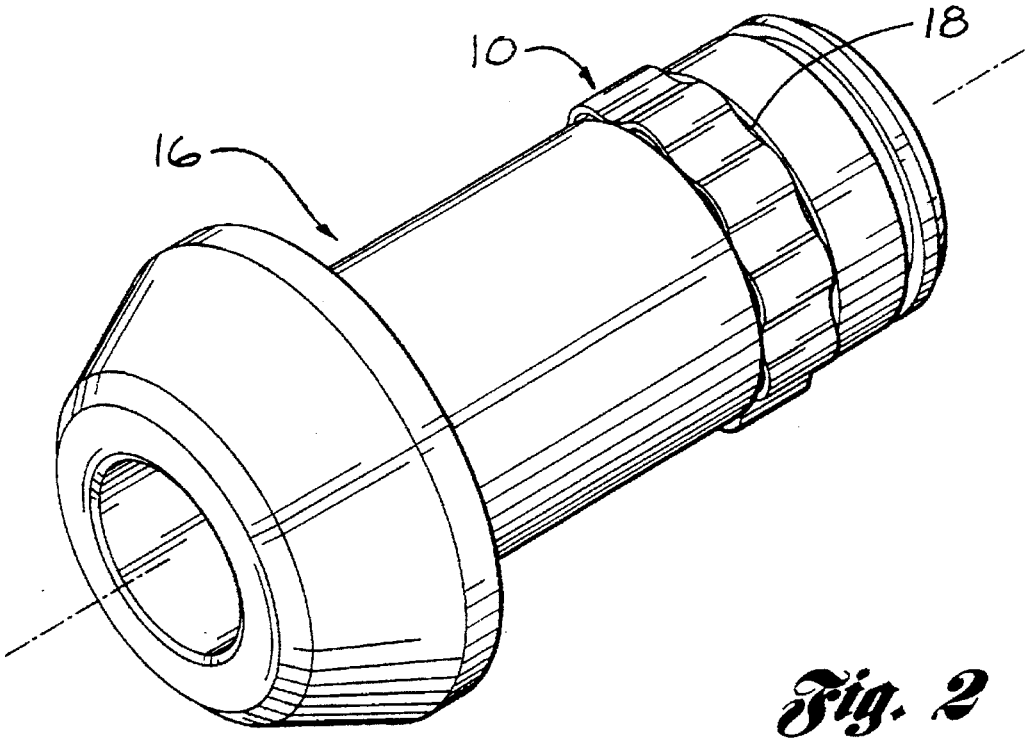
Fig. 2 (PRIOR ART)
FIG. 2 is an isometric view of a prior art support sleeve utilizing the prior art steel clip shown in FIG. 1.
Figures 3, 4:
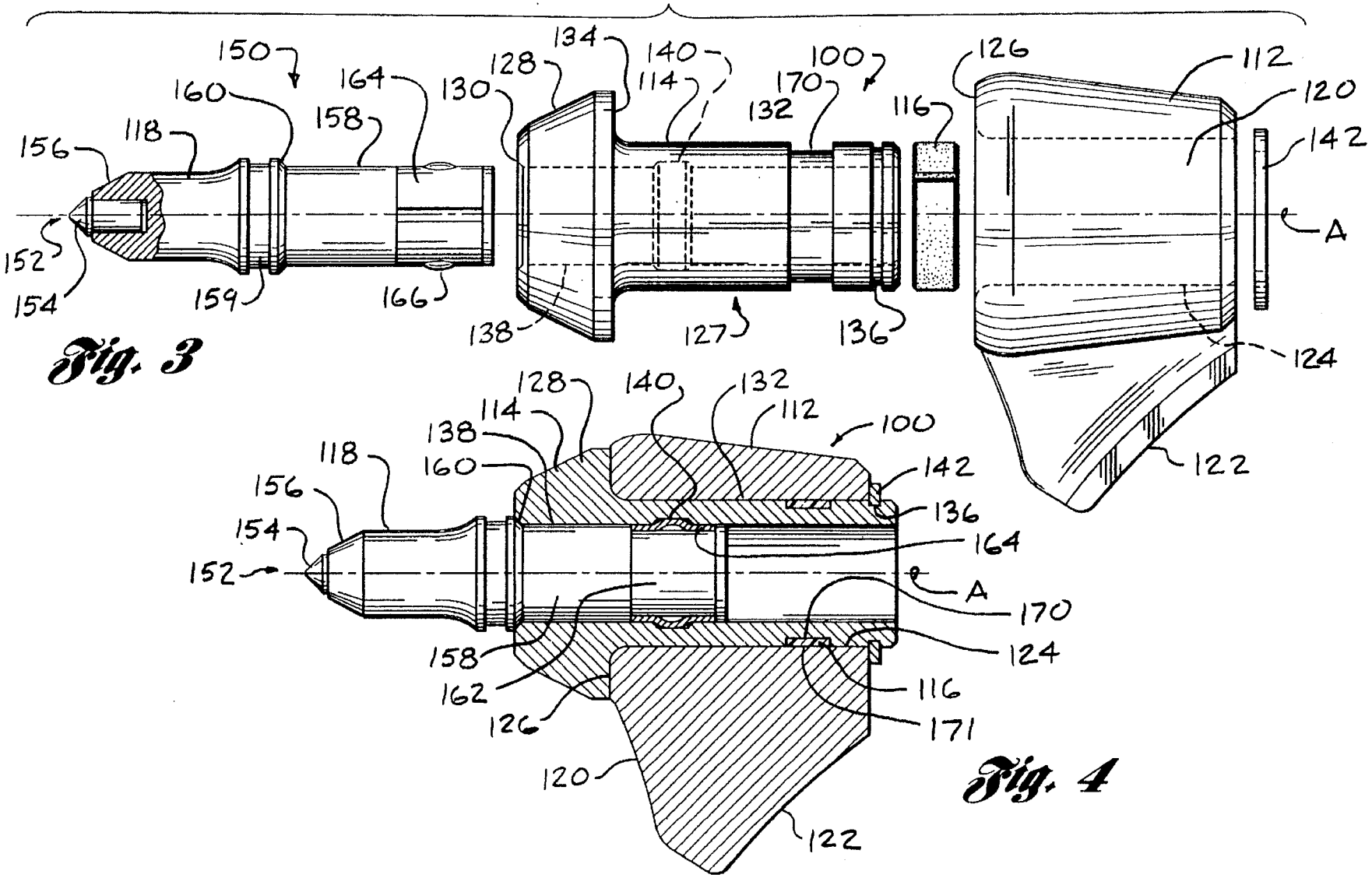
FIG. 3 is an exploded side elevational view showing a cutting tool, a support sleeve, a rotation limitation member, a support block and a retainer ring according to one embodiment of this invention.
FIG. 4 is side elevational view partly in section showing the assembled components of FIG. 3.

One embodiment of the tool sleeve rotation limitation system 100 is shown in FIGS. 3 and 4. The tool sleeve rotation limitation system 100 includes a support block 112, a tool sleeve 114, a sleeve rotation limitation member 116 and a cutting tool 118. In the embodiment shown, the cutting tool 118 may be mounted within the tool sleeve 114 which in turn may be mounted within the support block 112.

Such support blocks 112 typically have an exterior block surface 120 of which a portion is a block base 122. Such support blocks 112 also typically have a block bore 124 surrounded at the exterior block surface 120 by a seating shoulder region 126. Such support blocks are well known in the art and may have an infinite variety of configurations and dimensions.

In use, such support blocks 112 may be distributed over, and the block bases 122 may be welded or otherwise connected to, the circumference and length of a drum or other body (not shown) according to any desired pattern. While the block base 122 has been shown as comprising a curved surface for welding or otherwise connecting the support block 112 to the surface of a drum or the like, it will be understood that the support block could be shaped for mounting to any desired body, such as a chain link or any other suitable supporting or driving device. The drum or other body may be driven by any conventional or suitable drive mechanism to cause the cutting tools 118 to engage and break up material that they are applied to. Such applications are well known in the art.

Seated in the block bore 124 is the tool sleeve 114. The tool sleeve 114 has a sleeve body 127 which has a longitudinal axis "A". The sleeve body 127 has a large forward portion 128 which may have a generally conical shape as shown, the forwardmost portion of which comprises a sleeve seating region 130. The tool sleeve 114 also has a smaller diameter rearward portion 132 joined to the large forward portion 128 at a sleeve shoulder 134. The rearward portion 132, as shown in this embodiment, has a retainer groove 136. Additionally, the tool sleeve typically has a sleeve bore 138 which may, as shown in FIGS. 3 and 4, define a bore groove 140. Such tool sleeves are well known in the art and may have an infinite variety of configurations and dimensions.

As shown in FIG. 3, when the rearward portion 132 of the tool sleeve 114 is inserted into the block bore 124 such that the retainer groove 136 is exposed and the sleeve shoulder 134 abuts or is in close proximity to the seating shoulder region 126 of the support block 112, a retainer ring 142 may be placed within the retainer groove 136 to prevent the tool sleeve 114 from being dislodged from the block bore 124 during use. The use of such retainer rings is generally known in the art. Alternatively, other methods for mounting the tool sleeve within the block bore 124 of a support block 112 may be used. For example, another method of mounting utilizing multiple collar members and a snap ring is disclosed in the U.S. Pat. No. 5,067,775, to D'Angelo et al.

The cutting tool 118 typically has an elongated tool body 150. The cutting end 152 of the cutting tool 118 typically comprises a hard cutting insert 154 mounted onto a generally tapering outer region 156. This hard cutting insert 154 may be made from cemented tungsten carbide or any other suitable material. The hard cutting insert 154 is generally mounted at the end of the generally tapering outer region 156 where the cutting insert 154 may be brazed or otherwise suitably fastened into place. The cutting tool 118 also includes a tool shank 158 adjoining the outer region 156 at an annular tool groove 159 which is flared out to form a tool shoulder 160. The annular tool groove 159 is for the purpose of receiving a tool for removing the cutting tool 118 from the tool sleeve 114 when the cutting tool 118 is to be changed.

The tool shank 158 has an annular keeper groove 162 in which is seated a keeper member. The keeper member in the embodiment shown is a split ring band 164 having dimples or protuberances 166 distributed about the periphery of the split ring band 164. The keeper groove 162 and the protuberances 166 of the split ring band 164 are located along the tool shank 158 such that when the cutting tool 118 is inserted into the sleeve bore 138, as shown in FIG. 4, the protuberances 166 will snap into the bore groove 140 so as to retain the cutting tool 118 in an assembled relation with the tool sleeve 114. The keeper member in the form of split ring band 164 will yield inwardly in the sleeve bore 138 so as to permit the cutting tool 118 to be pushed into the sleeve bore 138 and will then snap outwardly into the bore groove 140 when the cutting tool 118 is completely seated in the sleeve bore 138. The split ring band 164 retains the cutting tool 118 in the tool sleeve 114 and permits a slight amount of axial movement of the cutting tool 118 in the sleeve bore 138 so that the tool shoulder 160 of the cutting tool 118 is not locked against the sleeve seating region 130 and the cutting tool 118 is rotatable within the sleeve bore 138. Because such cutting tool are generally known in the art, they will not be described in further detail here. Furthermore, it should be noted that this invention encompasses the use of any suitable cutting tool having any configuration.

For the purposes of this invention, and in order to reduce rotation of the tool sleeve 114 within the block bore 124 during use, the rotation limitation member 116 is placed between the tool sleeve 114 and the support block bore 124 so as to engage a sleeve engagement surface of the tool sleeve 114 and a block engagement surface of the block bore 124. In the embodiment shown, the sleeve engagement surface is a sleeve recess 170 in the rearward portion 132 of the tool sleeve 114 forward of the retainer groove 136. In the embodiment shown, the block engagement surface is the rotation limitation member 116 after the tool sleeve 114 has been assembled with the support block 112, such as the assembled relationship shown in FIG. 4. In the embodiment shown, the rotation limitation member 116 is located completely between the tool sleeve 114 and the block bore 124. More specifically, in the embodiment shown, the rotation limitation member 116 is placed within the sleeve recess 170 before the rearward portion 132 of the tool sleeve 114 is inserted into the block bore 124. The rotation limitation member 116 thus engages the sleeve recess 170 and a portion 171 of the block bore 124 and thereby reduces rotation of the tool sleeve 114. In the embodiment shown, the rotation is reduced by the frictional engagement of the rotation limitation member 116 with the tool sleeve 170 and the block bore 124. Such reduction of rotation may preclude rotation entirely.

The rotation limitation member 116 is preferably configured or dimensioned such that when the tool sleeve 114 is inserted into the block bore 124, the rotation limitation member 116 is compressed between the tool sleeve 114 and the block bore 124. Compression of the rotation limitation member 116 will increase the frictional engagement of the rotation limitation member 116 with the sleeve recess 170 and block bore 124 and reduce rotation of the tool sleeve 114 within the block bore 124 even further.

It is additionally preferable that the rotation limitation member be resilient which means that the rotation limitation member is preferably made from any non-metallic resilient material such as, without limitation, nylon, plastic, polymer or a urethane. An advantage of using non metallic resilient material, in addition to the advantages of being fatigue and wear resistent, is that the rotation limitation member will not be subject to corrosion. Because the moisture inherent in mining and excavating operations often contains corrosive acids, this is especially beneficial.

In the embodiment shown, the rotation limitation member comprises a sleeve rotation limitation member, such as the sleeve rotation members **116–116*h* illustrated in FIGS. 5–16, mounted in the sleeve recess 170**, which in this embodiment is an annular groove.

While many other configurations are possible, the rotation limitation members **116–116*h* shown in FIGS. 5–15 are C-clips. In other words, the rotation limitation members 116–116*h*** have the overall configuration of an incomplete circle.

No matter what configuration is used, the rotation limitation member will always have an member perimeter, the member perimeter being the perimeter of the rotation limitation member taken along a plane perpendicular to the tool sleeve axis, such as the axis "A" shown in FIGS. 3 and 4. The rotation limitation member will also always have a member surface. As will be shown in the various embodiments illustrated and described, it is preferable that at least a portion of the member perimeter, or at least a portion of the member surface, conform to at least one of the sleeve engagement and block engagement surfaces. This will reduce concentrated wear points and will also reduce bending stresses within the rotation limitation member which could otherwise contribute to fatigue failure. In the event frictional engagement is relied on, this will also increase the surface area of the rotation limitation member available for frictional engagement with the sleeve engagement surface and block engagement surface.

Figure 5:
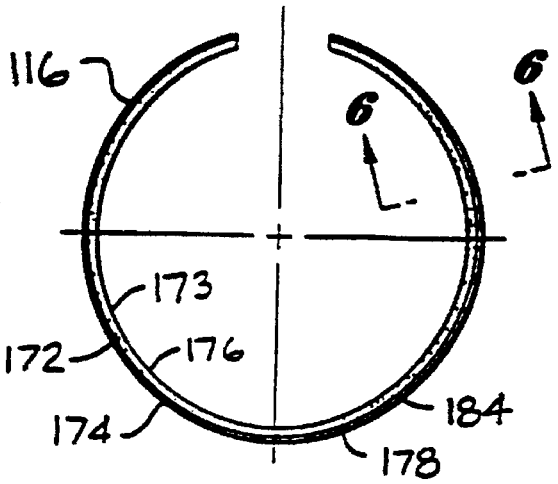
FIG. 5 is a front elevational view of one rotation limitation member embodiment of this invention.

For example, as shown in FIG. 5, the rotation limitation member 116 has a member surface 172 of which a portion is an inner surface 173 and an outer surface 174. The rotation limitation member 116 also has a member perimeter, the inner member perimeter 176 and outer member perimeter 178

Figure 6:
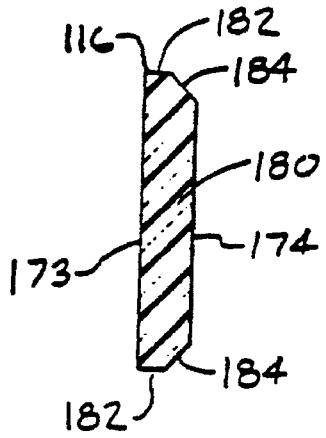
FIG. 6 is a cross-sectional view taken along line 6—6 of FIG. 5.

As shown in FIG. 6, the cross-section of the rotation limitation member 116 shown in FIG. 5 has a rotation limitation member body 180 which in this embodiment has a generally rectangular shape with side surfaces 182 and chamfers 184 along the two outer corners of the outer surface 174. This cross section is continuous throughout the entire length of the C-clip.

As previously noted, it is preferable that at least a portion of the member perimeter conform to at least one of the sleeve engagement and block engagement surfaces. In this embodiment, the total inner member perimeter 176 conforms to the sleeve engagement surface, the sleeve recess 170, and the total outer member perimeter 178 conforms to the block engagement surface, the portion 171 of the block bore 124. As also previously noted, it is alternatively preferable that at least a portion of the member surface 172 conform to at least one of the sleeve engagement and block engagement surfaces. In this embodiment, the total inner surface 173 conforms to the sleeve engagement surface, the sleeve recess 170, and the total outer surface 174 conforms to the block engagement surface, the portion 171 of the block bore 124.

This embodiment shown in FIGS. 5 and 6 has been found to work satisfactorily, for one example, in a support block having a block bore having a diameter within the tolerances of 2.000 to 2.003 inches with a tool sleeve having a rearward portion diameter within the tolerances of 1.991 to 1.996 inches, an annular sleeve recess diameter toleranced to 1.832±0.005 inches, and a sleeve recess width of 0.515 inches when a C-clip is used made from a Grade 6—6 Nylon and having an inside diameter toleranced to 1.820±0.004 inches, an outside diameter toleranced to 2.000±0.004 inches, and a width toleranced to 0.500±0.01 inches. Grade 6—6 Nylon is available from McMaster-Carr Supply Co., P.O. Box 440, New Brunswick, N.J. 08903.

Figure 7:
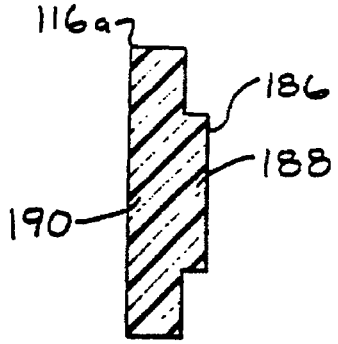
FIG. 7 is a cross-sectional view of another rotation limitation member embodiment of this invention.

FIGS. 7–10 are other possible cross-sections taken along a line similar to line 6—6 of FIG. 5, which show alternative cross-section configurations which likewise may be continuous throughout the entire length of a C-clip. For example, as shown in FIG. 7, a rotation limitation member 116*a* may have a continuous circumferential protuberance along the outer perimeter 186 of the C-clip, such as a rectangular protuberance 188 protruding from a larger rectangular body 190. Of course, while a rectangular protuberance 188 has been shown, any configuration or dimensioned protuberance may be used.

Figure 8:
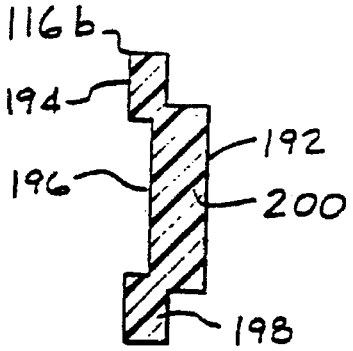
FIG. 8 is a cross-sectional view of another rotation limitation member embodiment of this invention.

Alternatively, as shown in FIG. 8, a rotation limitation member 116*b* may have outer surface 192, which defines an outer member perimeter, and an inner surface 194, which defines an inner member perimeter. The inner surface 194 may have a recess, such as a continuous circumferential rectangular recess 196 formed within a larger rectangular body 198. In the embodiment shown, the rotation limitation member 116*b* also has a continuous circumferential protuberance along the outer surface 192 of the C-clip which is a rectangular protuberance 200 protruding from the rectangular body 198. A recess along the inner surface 194, such as the rectangular recess 196 shown, allows the body 198 to deflect or bend into the recess 196 when the rotation limitation member 116*b* is compressed. Of course, while the recess has been shown on the inner surface, a recess could alternatively or additionally be formed on the outer surface. Furthermore, while a rectangular recess 196 has been shown, any configuration or dimensioned recess may be used which is suitable and such a recess need not be circumferentially continuous but may comprise any number of recesses along the inner or outer surface or both.

Figure 9:
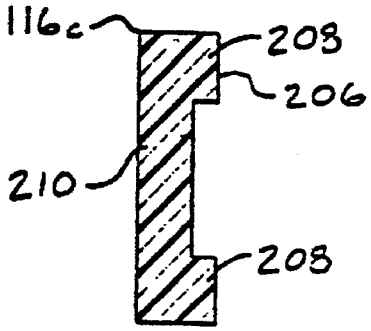
FIG. 9 is a cross-sectional view of another rotation limitation member embodiment of this invention.

As another alternative, as shown in FIG. 9, a rotation limitation member 116*c* may have two or more continuous circumferential protuberances along the outer surface 206 of the C-clip, such as two rectangular protuberances 208 protruding from a larger rectangular body 210 which define an outer member perimeter. While rectangular protuberances 208 are shown in FIG. 9, any configuration or dimensioned protuberances may be used which are suitable and such protuberances may be defined by the inner surface, outer surface, or both.

Figure 10:
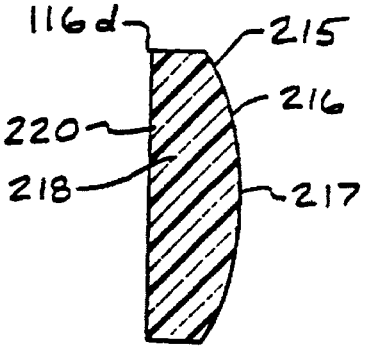
FIG. 10 is a cross-sectional view of another rotation limitation member embodiment of this invention.

As a further alternative, as shown in FIG. 10, a rotation limitation member 116*d* having a member surface 215 may have an outer surface of any configuration, such as the convex outer surface 216 having an apex 217 which defines an outer member perimeter. The convex outer surface 216 as shown protrudes from a generally rectangular body 218 having an inner surface 220 which defines an inner member perimeter. Of course, the body, the outer surface, and the inner surface of a rotation limitation member may have any configuration or dimensions found to be suitable.

In the embodiment shown in FIG. 10, the total length of the outer member perimeter defined by the apex 217 will conform to the block engagement surface, the portion 171 of the block bore 124, and the total length of the inner member perimeter and inner surface 220 conforms to the sleeve engagement surface, the sleeve recess 170.

Figure 11:
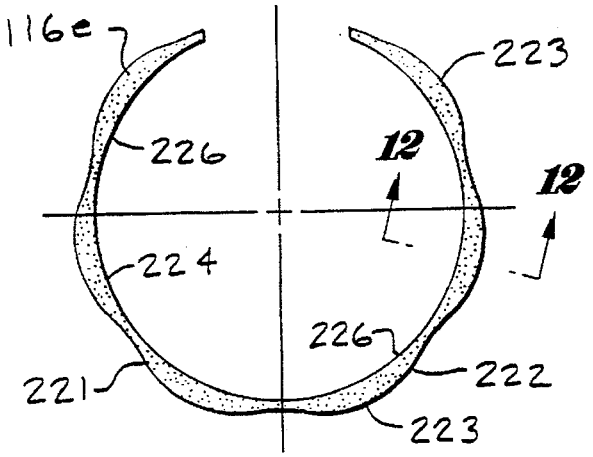
FIG. 11 is a front elevational view of another rotation limitation member embodiment of this invention.
Figure 12:
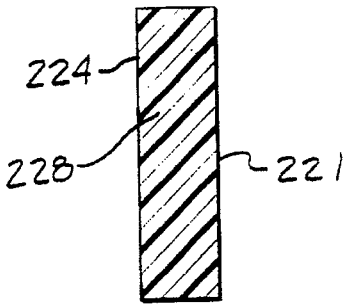
FIG. 12 is a sectional view taken along line 12—12 of FIG. 11.

Furthermore, as shown in FIGS. 11–15, a rotation limitation member in the form of a C-clip need not have a consistently continuous cross-section but instead may have a varying cross-section along the length of the rotation limitation member. For example, as shown in FIGS. 11 and 12, a rotation limitation member 116*e* may have an outer surface 221 and an outer member perimeter 222 which are not smooth or circular, but instead have a series of convex portions 223 or bumps along the outer perimeter 222. The rotation limitation member 116*e* also has an inner surface 224 and an inner member perimeter 226. Otherwise, as shown in FIG. 12, such a rotation limitation member 116*e* could have a rectangular body 228. Of course, the geometry of the outer surface 221, outer member perimeter 222, inner surface 224, and inner member perimeter 226, and the shape of the cross-section, could have any configuration or dimensions found suitable. Note that while neither a portion of the outer surface 221 nor a portion of the outer member perimeter 222 conforms to the block engagement surface, the portion 171 of the block bore 124, both the inner surface 224 and inner member perimeter 226 will conform to the sleeve engagement surface, the sleeve recess 170.

Figure 13:
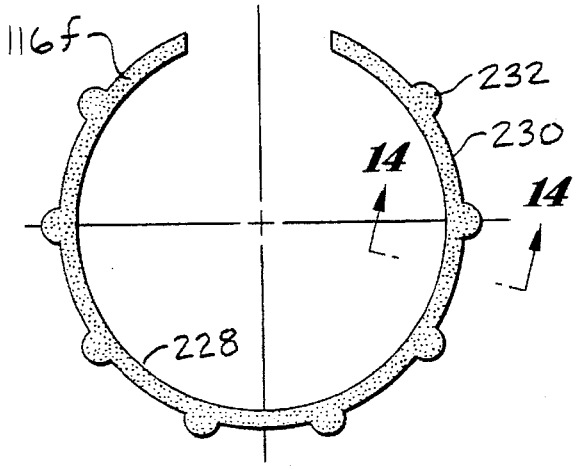
FIG. 13 is a front elevational view of another rotation limitation member embodiment of this invention.
Figure 14:
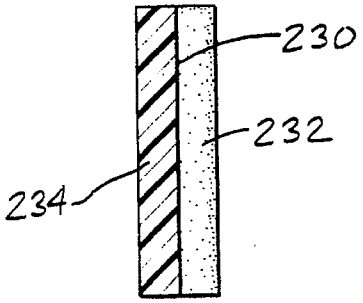
FIG. 14 is a cross-sectional view taken along line 14—14 of FIG. 13.

FIGS. 13 and 14 show yet another alternative embodiment in which a rotation limitation member 116*f* may have an inner surface 228 and a number of protuberances along the outer surface 230 of a C-clip such as the hemi-cylindrical protuberances 232 spaced along and protruding from a larger rectangular body 234 as shown in FIGS. 13 and 14. Again, while neither a portion of the outer surface 230 nor a portion of the outer member perimeter conforms to the block engagement surface, the portion 171 of the block bore 124, both the inner surface 228 and inner member perimeter will conform to the sleeve engagement surface, the sleeve recess 170. Of course, such protuberances could be located on the inner or outer surface, or both, and could have any configuration or dimensions found suitable.

Figure 15:
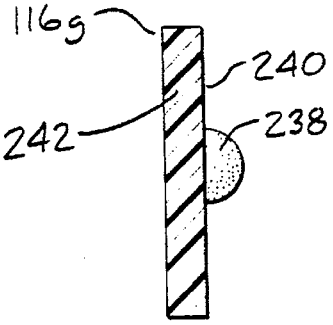
FIG. 15 is a cross-sectional view similar to the cross-sectional view taken along line 14—14 of FIG. 13.

For example, FIG. 15 shows a section similar to that shown in FIG. 14 except that the protuberances of the rotation limitation member 116*g* comprise a series of hemispherical projections 238 projecting from the outer surface 240 of the larger rectangular body 242.

Figure 16:
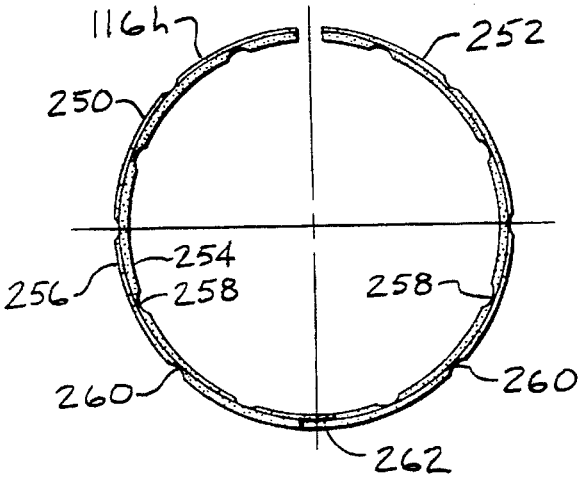
FIG. 16 is a front elevational view of another rotation limitation member embodiment of this invention.

FIG. 16 shows another alternative embodiment which is similar to FIG. 5 except that the rotation limitation member 116*h* is formed from two interlocking halves 250 and 252. Furthermore, the inner and outer perimeters, 254 and 256, are not continuous but instead have indentations, 258 and 260 respectively. Note that as preferred, at least a portion of the inner member perimeter 254, the portion between the indentations 258, conforms to the sleeve engagement surface, the sleeve recess 170. Likewise, at least a portion of the outer member perimeter 256, the portion between the indentations 260, conforms to the block engagement surface, the portion 171 of the block bore 124. While the rotation limitation member **116*h* is shown as comprising two halves 250 and 252**, a rotation limitation member may comprise any number of pieces having any suitable configuration and dimensions, whether interlocking or not.

While particular embodiments of the invention have been illustrated and described, it will be obvious to those skilled in the art that an infinite variety of changes and modifications may be made without departing from this invention. For example, and without limitation, the resilient rotation limitation members can have any configuration or dimensions found suitable. Furthermore, the rotation limitation members could be made from any suitable material. It is intended that the following claims cover all such modifications and all equivalents that fall within the spirit of this invention.

What is claimed is:

1. A tool sleeve rotation limitation system for reducing the rotation of a tool sleeve within a support block bore, the tool sleeve having a sleeve engagement surface and the block bore having a block engagement surface, the tool sleeve rotation limitation system comprising:

a rotation limitation member located completely between the tool sleeve and the block bore so as to engage the block engagement surface and the sleeve engagement surface and reduce rotation of the tool sleeve within the block bore, the rotation limitation member having a member perimeter which conforms to at least one of the sleeve engagement surface and the block engagement surface.

2. The tool sleeve rotation limitation system of claim 1 wherein the rotation limitation member has a member surface which conforms to at least one of the sleeve engagement surface and the block engagement surface.

3. The tool sleeve rotation limitation system of claim 1 wherein the rotation limitation member is compressed between the tool sleeve and the block bore.

4. The tool sleeve rotation limitation system of claim 3 wherein the rotation limitation member has a member recess, such that when the rotation limitation member is compressed between the tool sleeve and the block bore the member recess will allow the rotation limitation member to deflect into the member recess.

5. The tool sleeve rotation limitation system of claim 1 wherein the rotation limitation member frictionally engages the block engagement surface and the sleeve engagement surface.

6. The tool sleeve rotation limitation system of claim 1 wherein the rotation limitation member is made from a non-metallic resilient material.

7. The tool sleeve rotation limitation system of claim 1 wherein the sleeve engagement surface is a sleeve recess.

8. The tool sleeve rotation limitation system of claim 7 wherein the sleeve recess is an annular sleeve recess.

9. The tool sleeve rotation limitation system of claim 8 wherein the rotation limitation member has a member surface which conforms to at least one of the annular sleeve recess and the block engagement surface.

10. The tool sleeve rotation limitation system of claim 8 wherein the rotation limitation member is compressed between the tool sleeve and the block bore.

11. The tool sleeve rotation limitation system of claim 10 wherein the rotation limitation member has a member recess, such that when the rotation limitation member is compressed between the tool sleeve and the block bore the member recess will allow the rotation limitation member to deflect into the member recess.

12. The tool sleeve rotation limitation system of claim 8 wherein the rotation limitation member frictionally engages the annular sleeve recess and the block engagement surface.

13. The tool sleeve rotation limitation system of claim 8 wherein the rotation limitation member has a C-clip configuration.

14. The tool sleeve rotation limitation system of claim 8 wherein the rotation limitation member is made from a non-metallic resilient material.

15. A tool sleeve rotation limitation system for reducing the rotation of a tool sleeve within a support block bore, the tool sleeve rotation limitation system comprising:

a non-metallic resilient rotation limitation member located completely between the tool sleeve and the block bore so as to frictionally engage the tool sleeve and the block bore and reduce rotation of the tool sleeve within the block bore.

16. The tool sleeve rotation limitation system of claim 15 wherein the non-metallic resilient rotation limitation member is compressed between the tool sleeve and the block bore.

17. The tool sleeve rotation limitation system of claim 16 wherein the non-metallic resilient rotation limitation member has a member recess, such that when the non-metallic resilient rotation limitation member is compressed between the tool sleeve and the block bore the member recess will allow the non-metallic resilient rotation limitation member to deflect into the member recess.

18. The tool sleeve rotation limitation system of claim 15 wherein the non-metallic resilient rotation limitation member frictionally engages the block bore and the tool sleeve.

19. The tool sleeve rotation limitation system of claim 15 wherein the tool sleeve has a sleeve recess and the non-metallic resilient rotation limitation member engages the sleeve recess.

20. The tool sleeve rotation limitation system of claim 19 wherein the sleeve recess is an annular sleeve recess.

21. The tool sleeve rotation limitation system of claim 20 wherein the non-metallic resilient rotation limitation member is compressed between the tool sleeve and the block bore.

22. The tool sleeve rotation limitation system of claim 21 wherein the non-metallic resilient rotation limitation member has a member recess, such that when the non-metallic resilient rotation limitation member is compressed between the tool sleeve and the block bore the member recess will allow the non-metallic resilient rotation limitation member to deflect into the member recess.

23. The tool sleeve rotation limitation system of claim 20 wherein the non-metallic resilient rotation limitation member frictionally engages the block bore and the annular sleeve recess.

24. The tool sleeve rotation limitation system of claim 20 wherein the non-metallic resilient rotation limitation member has a C-clip configuration.

25. A rotation limitation member for use with a tool sleeve having an annular sleeve recess and a support block bore having a block engagement surface, the rotation limitation member comprising:

a non-metallic resilient C-clip; and wherein said non-metallic resilient C-clip is mounted in the annular sleeve recess for engagement with the block engagement surface to limit rotation of the tool sleeve when mounted in the support block bore.

26. The tool sleeve rotation limitation system of claim 25 wherein the C-clip has a generally rectangular cross-section.

27. The tool sleeve rotation limitation system of claim 25 wherein the C-clip has a recess.

28. The tool sleeve rotation limitation system of claim 25 wherein the C-clip has a protrusion.

29. The tool sleeve rotation limitation system of claim 25 wherein the C-clip has a varying cross-section along the length of the C-clip.

30. The tool sleeve rotation limitation system of claim 25 wherein the C-clip has a member perimeter which conforms to at least one of the sleeve engagement surface and the block engagement surface.

31. The tool sleeve rotation limitation system of claim 25 wherein the C-clip has a member surface which confroms to at least one of the sleeve engagement surface and the block engagement surface.

32. A tool sleeve rotation limitation system for reducing the rotation of a tool sleeve within a support block bore, the tool sleeve having a sleeve engagement surface and the block bore having a block engagement surface, the tool sleeve rotation limitation system comprising:

a rotation limitation member located between the tool sleeve and the block bore so as to engage the block engagement surface and the sleeve engagement surface and reduce rotation of the tool sleeve within the block bore, the rotation limitation member having a member perimeter which conforms to at least one of the sleeve engagement surface, the block engagement surface, and wherein the sleeve engagement surface is an annular sleeve recess.

33. The tool sleeve rotation limitation system of claim 32 wherein the rotation limitation member has a member surface which conforms to at least one of the annular sleeve recess and the block engagement surface.

34. The tool sleeve rotation limitation system of claim 32 wherein the rotation limitation member is compressed between the tool sleeve and the block bore.

35. The tool sleeve rotation limitation system of claim 34 wherein the rotation limitation member has a member recess, such that when the rotation limitation member is compressed between the tool sleeve and the block bore the member recess will allow the rotation limitation member to deflect into the member recess.

36. The tool sleeve rotation limitation system of claim 32 wherein the rotation limitation member frictionally engages the annular sleeve recess and the block engagement surface.

37. The tool sleeve rotation limitation system of claim 32 wherein the rotation limitation member has a C-clip configuration.

38. The tool sleeve rotation limitation system of claim 32 wherein the rotation limitation member is made from a resilient material.

39. A tool sleeve rotation limitation system for reducing the rotation of a tool sleeve within a support block bore, the tool sleeve rotation limitation system comprising:

a resilient rotation limitation member located between the tool sleeve and the block bore so as to frictionally engage the tool sleeve and the block bore and reduce rotation of the tool sleeve within the block bore, and wherein the tool sleeve has an annular sleeve recess and the resilient rotation limitation member engages the annular sleeve recess.

40. The tool sleeve rotation limitation system of claim 39 wherein the resilient rotation limitation member is compressed between the tool sleeve and the block bore.

41. The tool sleeve rotation limitation system of claim 40 wherein the resilient rotation limitation member has a member recess, such that when the resilient rotation limitation member is compressed between the tool sleeve and the block bore the member recess will allow the resilient rotation limitation member to deflect into the member recess.

42. The tool sleeve rotation limitation system of claim 39 wherein the resilient rotation limitation member frictionally engages the block bore and the annular sleeve recess.

43. The tool sleeve rotation limitation system of claim 39 wherein the resilient rotation limitation member has a C-clip configuration.

44. A rotation limitation member for use with a tool sleeve having an annular sleeve recess and a support block bore having a block engagement surface, the rotation limitation member comprising:

a resilient C-clip having a protrusion.

45. A rotation limitation member for use with a tool sleeve having an annular sleeve recess and a support block bore having a block engagement surface, the rotation limitation member comprising:

a resilient C-clip having a varying cross-section along the length of the C-clip.

* * * * *